US008752223B2

(12) United States Patent
Hanlon

(10) Patent No.: US 8,752,223 B2
(45) Date of Patent: Jun. 17, 2014

(54) PULLING TOOLS

(75) Inventor: Jared W. Hanlon, Santa Clarita, CA (US)

(73) Assignee: Pull'R Holding Company, LLC, Schaumburg, IL (US)

( * ) Notice: Subject to any disclaimer, the term of this patent is extended or adjusted under 35 U.S.C. 154(b) by 261 days.

(21) Appl. No.: 13/353,230

(22) Filed: Jan. 18, 2012

(65) Prior Publication Data

US 2012/0110745 A1 May 10, 2012

Related U.S. Application Data

(63) Continuation-in-part of application No. 13/296,123, filed on Nov. 14, 2011, now Pat. No. 8,381,340, which is a continuation of application No. 12/220,456, filed on Jul. 23, 2008, now Pat. No. 8,056,170, which is a continuation of application No. 29/254,444, filed on Feb. 23, 2006, now Pat. Des. 579,292.

(51) Int. Cl.
*B25F 1/00* (2006.01)
*B25C 11/00* (2006.01)

(52) U.S. Cl.
CPC .. *B25F 1/00* (2013.01); *B25C 11/00* (2013.01)
USPC ..... 7/138; 7/164; 7/166

(58) Field of Classification Search
USPC ..... 7/138, 164, 166, 169
See application file for complete search history.

(56) References Cited

U.S. PATENT DOCUMENTS

| | | | | | |
|---|---|---|---|---|---|
| 147,113 | A | * | 2/1874 | Ellsworth | 7/147 |
| 165,671 | A | | 7/1875 | Hagerty | |
| 292,168 | A | * | 1/1884 | Lytle | 7/138 |
| 318,920 | A | * | 5/1885 | Lytle | 7/145 |
| 363,331 | A | * | 5/1887 | Hammer | 7/138 |
| 506,832 | A | | 10/1893 | Schofield | |
| 745,984 | A | * | 12/1903 | Alkire | 242/442 |
| 968,106 | A | | 8/1910 | Zimmermann | |
| D45,761 | S | | 5/1914 | Miller | |
| D53,352 | S | * | 5/1919 | Brace | D8/17 |
| D53,613 | S | | 7/1919 | Rockwell | |
| 1,356,431 | A | * | 10/1920 | Eddy | 7/164 |
| 1,413,798 | A | * | 4/1922 | Shinn | 81/158 |
| 1,422,689 | A | | 7/1922 | Funk | |
| 1,472,517 | A | | 10/1923 | Fry | |
| 1,562,018 | A | * | 11/1925 | Warff | 81/437 |
| 1,581,119 | A | | 4/1926 | Herring | |
| D70,218 | S | | 5/1926 | Gilbert | |
| 1,584,422 | A | | 5/1926 | Bate | |
| 1,596,602 | A | | 8/1926 | Egan | |
| 1,682,694 | A | * | 8/1928 | Losey | 7/146 |
| 1,689,585 | A | | 10/1928 | Haschart | |

(Continued)

OTHER PUBLICATIONS

The Japan Woodworker—Spring-Summer 2002, Google Catalogs [online], [retrieved from Google Catalogs using Internet URL: http://catalogs.google.com/catalogs?vid=0RuOBjdgxqvXw&id=1PcMN4XqxMUC&printsec=frontcovers&.

*Primary Examiner* — David B Thomas

(74) *Attorney, Agent, or Firm* — Cherskov Flaynik & Gurda, LLC

(57) ABSTRACT

A multi-function tool having a handle portion and a plurality of structures operable therewith for the performance of a plurality of functions. The multi-function tool allows fast and convenient transition between any of the plurality of functions in order to enable completion of jobs or tasks requiring such functions without acquisition, storage, and/or maintenance of a plurality of specialized tools.

9 Claims, 5 Drawing Sheets

(56) References Cited

U.S. PATENT DOCUMENTS

| | | | | | |
|---|---|---|---|---|---|
| 2,148,573 | A | | 2/1939 | Mulcay | |
| D138,790 | S | | 7/1944 | Czekalski | |
| 2,300,840 | A | | 11/1945 | Huxel | |
| D152,822 | S | * | 2/1949 | Overshiner | D8/16 |
| 2,528,128 | A | * | 10/1950 | Forster | 7/142 |
| 2,802,259 | A | * | 8/1957 | Stoner | 30/429 |
| 3,119,424 | A | * | 1/1964 | Henry | 81/20 |
| D197,915 | S | * | 4/1964 | Ayars | D8/26 |
| 4,028,970 | A | * | 6/1977 | Pelczar | 81/165 |
| 4,224,544 | A | | 9/1980 | McKinnon et al. | |
| 4,597,123 | A | | 7/1986 | Cobe, Jr. | |
| 5,103,520 | A | | 4/1992 | Mazzo | |
| 5,345,636 | A | * | 9/1994 | Lamons | 7/139 |
| 5,385,071 | A | * | 1/1995 | Her | 81/177.7 |
| 5,575,074 | A | * | 11/1996 | Cottongim et al. | 33/474 |
| 5,697,166 | A | * | 12/1997 | Hommel | 33/758 |
| 5,806,383 | A | * | 9/1998 | Hsieh | 81/170 |
| 5,826,466 | A | * | 10/1998 | Weissbach | 81/26 |
| 6,629,684 | B2 | | 10/2003 | Youngren et al. | |
| D507,167 | S | | 7/2005 | Richardson | |
| 7,013,516 | B1 | * | 3/2006 | Peters | 7/146 |
| D518,343 | S | | 4/2006 | Kellenghan | |
| D525,506 | S | | 7/2006 | Downing, Jr. | |
| D579,292 | S | | 10/2008 | Hanlon | |
| D597,389 | S | * | 8/2009 | Davidson | D8/27 |
| 2006/0075572 | A1 | | 4/2006 | Young | |
| 2006/0174730 | A1 | * | 8/2006 | Stewart | 81/98 |
| 2007/0006686 | A1 | * | 1/2007 | Warren et al. | 81/20 |
| 2007/0289415 | A1 | | 12/2007 | Hsieh | |
| 2010/0077553 | A1 | * | 4/2010 | Davidson et al. | 7/138 |
| 2010/0199814 | A1 | * | 8/2010 | Lee et al. | 81/177.1 |
| 2012/0291595 | A1 | * | 11/2012 | Hemesath | 81/119 |

* cited by examiner

PULLING TOOLS

CROSS-REFERENCE TO RELATED APPLICATION

The present U.S. Non-Provisional patent application cross-references and claims priority and benefit as a continuation-in-part of co-pending U.S. Utility application Ser. No. 13/296,123, filed on Nov. 14, 2011, presently pending, which in turn claims priority to U.S. Utility application Ser. No. 12/220,456 filed on Jul. 23, 2008, registered as U.S. Pat. No. 8,056,170 on Nov. 15, 2011 which in turn claimed priority to U.S. Design patent application Serial No. 29/254,444, filed Feb. 23, 2006, which issued as Design Pat. D579,292 on Oct. 28, 2008 each application is hereby incorporated by reference in its entirety.

TECHNICAL FIELD

The present disclosure relates generally to hand tools, and, more particularly, to construction tools, such as a pulling tool, or the like.

BACKGROUND OF THE INVENTION

Construction work typically requires the use of a plurality of tools, including hand tools and electric tools. Necessary hand tools usually include tools designed for joining particular materials together, as well as tools designed to assist in breaking apart construction materials, such as when improper installation or measurement error is detected. Electric tools, such as saws, drills, and the like, further frequently necessitate the utilization of additional tools, such as chucks, for adjustment, adaptation, and exchange of component parts during a project. Thus, each construction worker is often faced with a myriad of tools to transport.

Transport of such a collection of tools to a jobsite is a dubious task in and of itself, but maintaining mobility of such a number of tools and exchanging between tools while working is disadvantageously time and energy consuming. Further disadvantages can be realized directly by the workforce. That is, in addition to time and material costs, worker performance can be compromised by premature exhaustion as a result of repeatedly expending energy exchanging between a plurality of heavy tools, and necessarily transporting those tools about a work site.

Thus, it is clear that there is an unmet need for a construction tool that advantageously provides a plurality of on-board tools to assist in user accomplishment of a variety of tasks at a given job site, coincidentally maximizing workforce energy and efficiency.

BRIEF SUMMARY OF THE INVENTION

Briefly described, in an exemplary embodiment, the pulling tool of the present disclosure overcomes the above-mentioned disadvantages and meets the recognized need for such a tool by providing a non-threaded fastener pulling tool having a saw wrench, nail pick, and bottle opener.

More specifically, the exemplary pulling tool of the present disclosure includes a generally elongated handle portion with a lever pulling head at a first end of the handle portion, and a nail pick at a second end of the handle portion. The handle portion preferably includes generally broad, flat side-wall surfaces for stability and strength, wherein at least one of which is adapted to receive a plurality of on-board tools. The handle portion may further include generally narrow edge surfaces, at least one of which may be adapted with grip-enhancing features. Thus, the handle portion is generally formed as a sturdy bar, grippable for ease of use in a plurality of positions relative to the workpiece. The handle portion may also include a comfortable grip operable therewith to provide a comfortable gripping surface by which a user may grasp the tool, while maintaining strength of hold, wherein such a comfort grip may be provided in addition to or in lieu of the on-board grip-enhancing features.

The nail pick portion is generally a slightly angular extension of the handle and has a preferably broad front and rearward surface, corresponding to the broad, flat side-wall surfaces of the handle, to facilitate effective delivery of prying forces, such as to withdraw nails from a workpiece. The lever pulling head, or non-threaded fastener puller, similarly has a broad front and rearward surface, however, the broadened tine or claw of the pulling surfaces preferably extends dimensionally and angularly from the heel, which corresponds to the narrow edge surfaces of the handle. This facilitates effective delivery of lever action, such as to pull nails firmly embedded in a workpiece. For example, while removal of an improperly positioned nail may require a simple nail pick, some instances of fully seated nails may necessitate the use of a pulling lever claw for beneficial fulcrum action.

The generally broad, flat side-wall surface of the handle portion proximate the heel of the lever pulling head may preferably include additional useful tools, such as a saw wrench, a bottle opener, and an open wrench. The optional saw wrench is preferably disposed as a functional feature extending from the handle side-wall surface, with an outer edge angularly disposed relative to the plane of the handle side-wall. Such an orientation facilitates access to the recess wrench feature while also enabling a user to retain grippable positioning of the tool relative to the workpiece. That is, the configuration is preferred for use with a circular saw, wherein a blade fastener may be engaged by the saw wrench, with the handle of the tool extending away from the saw blade surface due to the angular outer edge of the saw wrench such that the user may grip the handle for application of force to loosen and remove the fastener without fear of inadvertent engagement with the saw blade. For example, the saw wrench may extend to an angle approximately equal to 60 degrees and preferably greater than 45 degrees.

The optional bottle opener may preferably be disposed proximate the saw wrench, on the handle side-wall, in order to facilitate insertion of a capped bottle according to the traditional functional configuration of a bottle opener, wherein pulling forces applied to the handle of the tool can easily and effectively remove a bottle cap. Preferably abutting the bottle opener, the optional open wrench may extend outwardly from the handle side-wall, preferably with a length of extension greater than that of the bottle opener or saw wrench relative to the side-wall. The wrench is preferably open such that a narrow article could be inserted therewithin via the open side. The outer edge of the open wrench is preferably generally flat, with the elongated nature of the preferred wrench socket facilitating loosening of even deep set bolts with application of the handle leverage.

Accordingly, one feature and advantage of the tool of the present disclosure is its ability to provide a strong handle portion having surfaces adapted to grip comfort and easy application of force during a plurality of tool uses.

Another feature and advantage of the tool of the present invention is its ability to provide grip-enhancing recesses that facilitate grasping of the edges of the device.

Another feature and advantage of the tool of the present disclosure is its ability to provide a durable pulling tool capable of delivering leveraged forces while providing a beneficial weight distribution and balance for ease of use.

Yet another feature and advantage of the tool of the present disclosure is its ability to provide a plurality of on-board tools to efficiently assist in the accomplishment of a plurality of construction-related tasks.

Still another feature and advantage of the tool of the present disclosure is its ability to perform as a balanced lever for transfer of forces.

Yet still another feature and advantage of the tool of the present disclosure is its ability to provide a bottle opener for opening bottles.

Still yet another feature and advantage of the tool of the present disclosure is its ability to eliminate the need for the transport of a plurality of specialized tools to a work site.

Another feature and advantage of the tool of the present disclosure is its ability to provide for user performance of a variety of different work efforts, according to the nature of the job component needs.

Still another feature and advantage of the tool of the present disclosure is its ability to provide a nail picking region to offer assistance with nail removal.

And yet still another feature and advantage of the tool of the present disclosure is its ability to provide a non-threaded fastener puller that can leverage forces for maximum work.

Another feature and advantage of the tool of the present disclosure is its ability to provide a saw wrench that can facilitate the quick removal and secure replacement of circular saw blades.

Still another feature and advantage of the tool of the present disclosure is its ability to provide am open wrench that can facilitate the loosening and/or tightening of even deeply recessed bolts.

These and other features and advantages of the tool of the present disclosure will become more apparent to those ordinarily skilled in the art after reading the following Detailed Description of the Invention and Claims in light of the accompanying drawing Figures.

BRIEF DESCRIPTION OF THE DRAWINGS

Accordingly, the present disclosure will be understood best through consideration of, and with reference to, the following drawings, viewed in conjunction with the Detailed Description of the Invention referring thereto, in which like reference numbers throughout the various drawings designate like structure, and in which.

Figure 1:
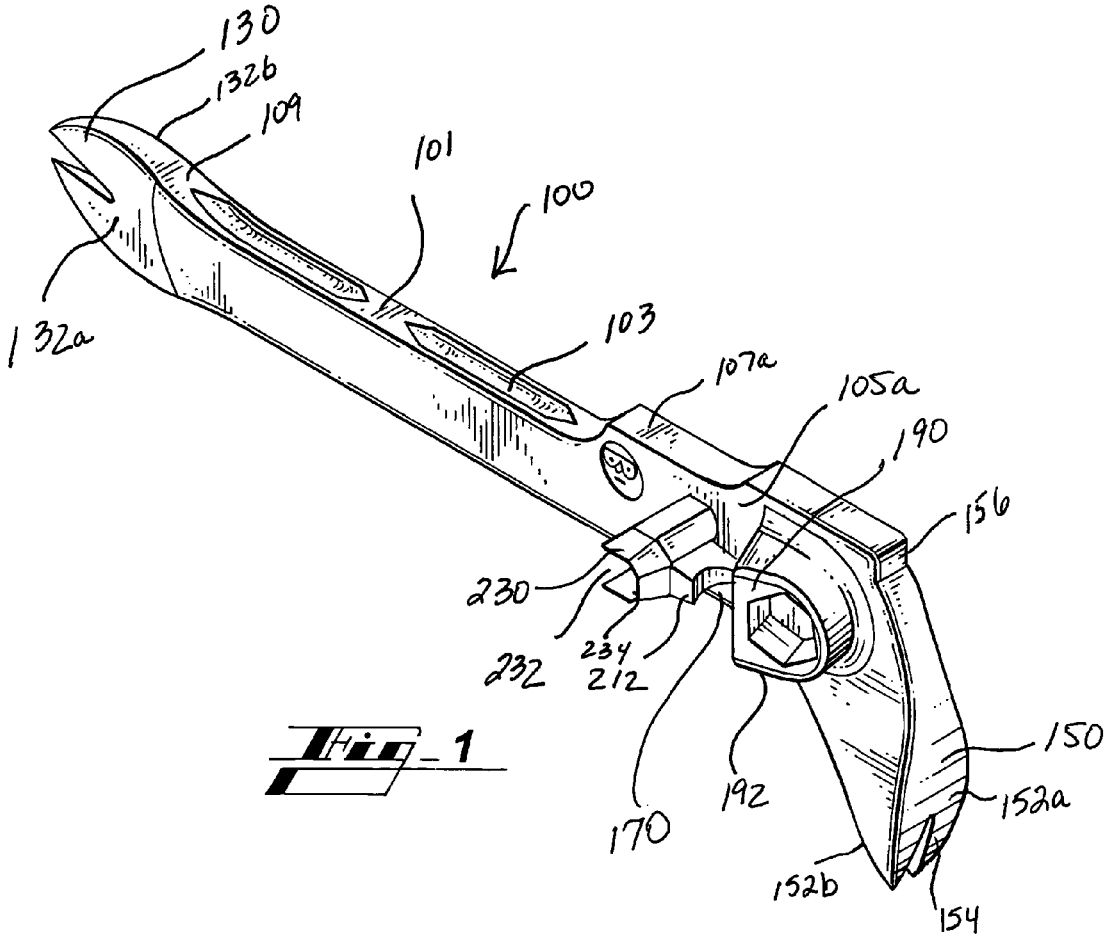
FIG. 1 is a perspective view of the pulling tool of the present disclosure, according to a preferred embodiment.

It is to be noted that the drawings presented are intended solely for the purpose of illustration and that they are, therefore, neither desired nor intended to limit the scope of the disclosure to any or all of the exact details of construction shown, except insofar as they may be deemed essential to the claimed invention.

DETAILED DESCRIPTION OF THE INVENTION

In describing exemplary embodiments of the hammer of the present disclosure illustrated in the drawings, specific terminology is employed for the sake of clarity. The claimed invention, however, is not intended to be limited to the specific terminology so selected, and it is to be understood that each specific element includes all technical equivalents that operate in a similar manner to accomplish a similar purpose.

Figure 2:
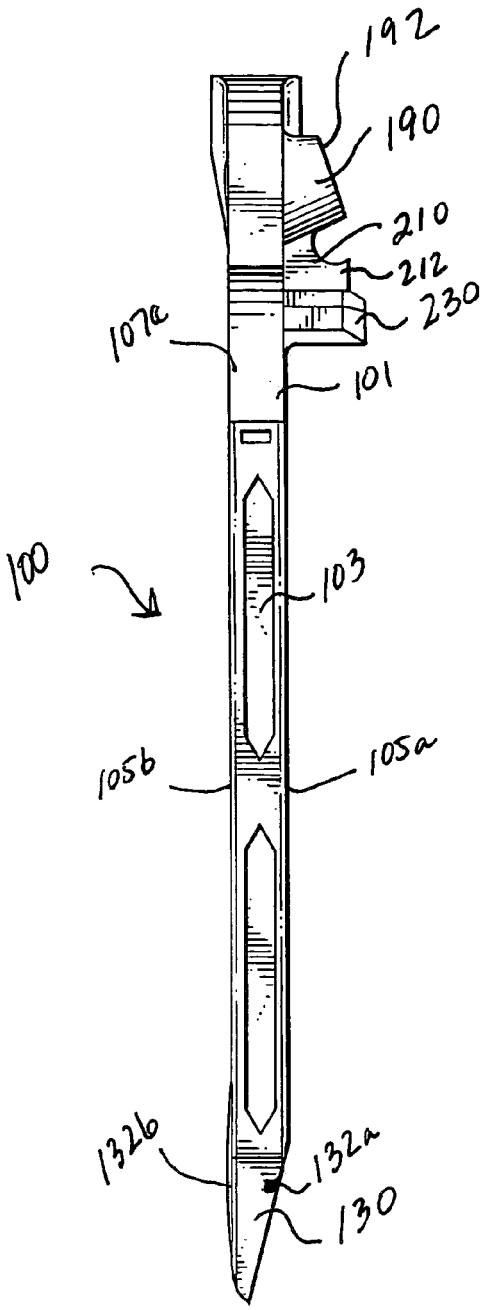
FIG. 2 is a top view of the pulling tool of FIG. 1.
Figure 3:
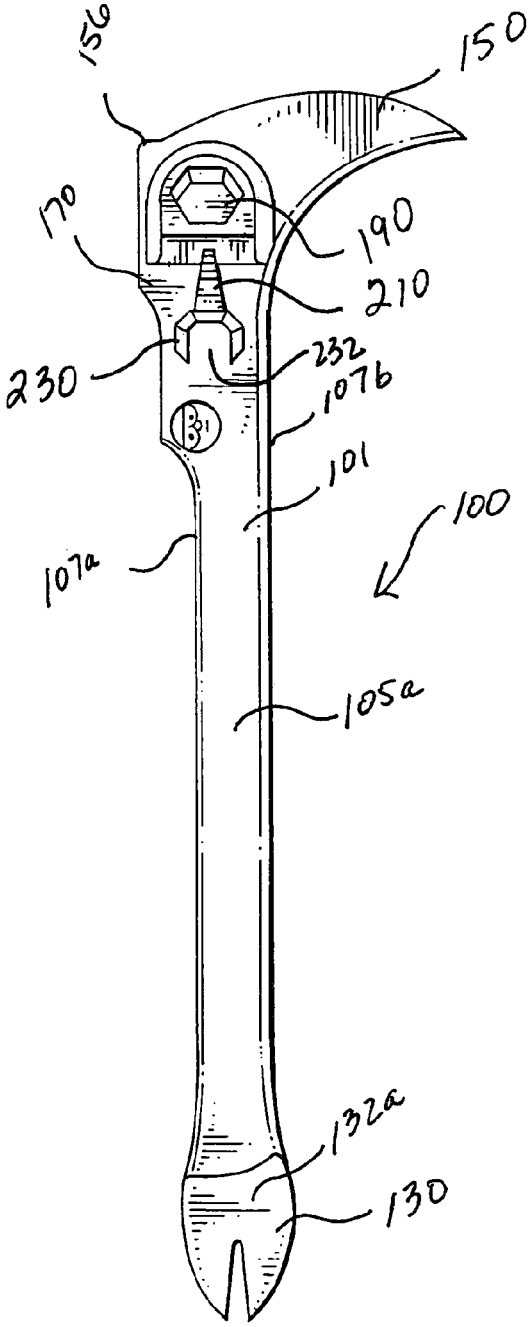
FIG. 3 is a side view of the pulling tool of FIG. 1.

In that form of the pulling tool of the present disclosure chosen for purposes of illustration, FIGS. 1-3 show tool 100 including handle 101 and grip features 103. Handle 101 is preferably formed from a suitable metal, composite, or synthetic material, or the like, defining nail pick tool 130 and levered pulling head 150, and may include a comfort grip member (not shown) installed thereon. The comfort grip member may be formed from natural or synthetic rubber, plastic, composite, form, combinations, or the like, and may be resilient and/or sculptured or contoured to provide a comfortable and secure grasping surface.

Handle 101 is preferably configured to provide durability and/or strength while reducing a total mass thereof and while providing a beneficial balance or distribution of mass, preferably defining a bar shape, with broad sidewall surfaces 105*a*, 105*b* and narrow edge surfaces 107*a*, 107*b*. Preferably, grip features 103 are defined in narrow edge surface 107*a*, disposed in a balanced arrangement, and recessed relative to narrow edge surface 107*a*. The preferred shape for grip features 103 is that of an elongate hexagonal shape, wherein the length of each recess facilitates reception of one or more fingertips of a user therein for grip enhancement. As noted, handle 101 may also include a comfortable grip operable therewith to provide a comfortable and secure gripping surface by which a user may grasp the tool.

Nail pick tool 130 is preferably included at a distal end 109 of handle 101, and is preferably wedge-shaped, as best seen in FIG. 2, to facilitate effective delivery of prying forces. Pick surface 132*a* is preferably angularly related to sidewall surface 105*a*, and pick surface 132*b* is preferably coplanar with sidewall surface 105*b*. This configuration facilitates the pulling action of nail pick tool 130.

The non-threaded fastener puller, or lever pulling head, 150 preferably has broad front and rearward surfaces 152*a*, 152*b*. The broadened tine or claw 154 of pulling surfaces 152*a*, 152*b* preferably extends dimensionally and angularly from heel 156, which may extend from narrow edge surface 107*a* of handle 101. This facilitates effective delivery of lever action, such as to pull nails firmly embedded in a workpiece. Non-threaded fastener puller 150 may be thus adapted to pry articles, such as nails, via application of force to handle 101.

Tool zone 170 of broad side-wall surface 105*a* of handle 101 is preferably provided proximate heel 156 of lever pulling head 150 and may include a variety of additional useful tools. In one preferred embodiment, tool zone 170 may include saw wrench 190, bottle opener 210, and open wrench 230. Saw wrench 190 is preferably disposed as a functional feature extending from side-wall surface 105*a*, with outer edge 192 angularly disposed relative to the plane of side-wall 105*a*. Once again, this preferred angular outer edge 192 facilitates positioning of puller 100 in a default extension position, wherein second end 109 of handle 101 is outwardly and angularly extended relative to the saw work surface upon which saw wrench 190 is being utilized. In such manner, a user may be able to retain a safe grip at a distance removed from the blade edge during circular saw blade removal and installation. The preferred angular disposition is about 60 degrees, and preferably greater than 45 degrees.

Optional bottle opener 210 may be positioned proximate saw wrench 190, on handle side-wall 105*a*. The preferred traditional configuration of bottle opener 210 includes cap lip 212, wherein outer edge 192 of saw wrench 190 performs as a fulcrum for bottle opener leverage. Preferably abutting bottle opener 210, and opposingly positioned to saw wrench 190, optional open wrench 230 may also extend outwardly from handle side-wall 105*a*, preferably with a length of extension greater than that of bottle opener 210 or saw wrench 190 relative to side-wall 105*a*. Preferably, opening 232 is defined in open wrench 230 in order that a nut may be selectively slidably inserted therethrough, rather than from outer end 234. The open wrench is preferably approximately octagonal in shape wherein three sides of the octagon are missing, thereby providing two parallel sides of the octagon proximate the opening for gripping of bolts and the like. The extended socket of the open wrench may be generally narrowed in the top portion to provide a sharp edge along the top rim of the wrench.

Figure 4:
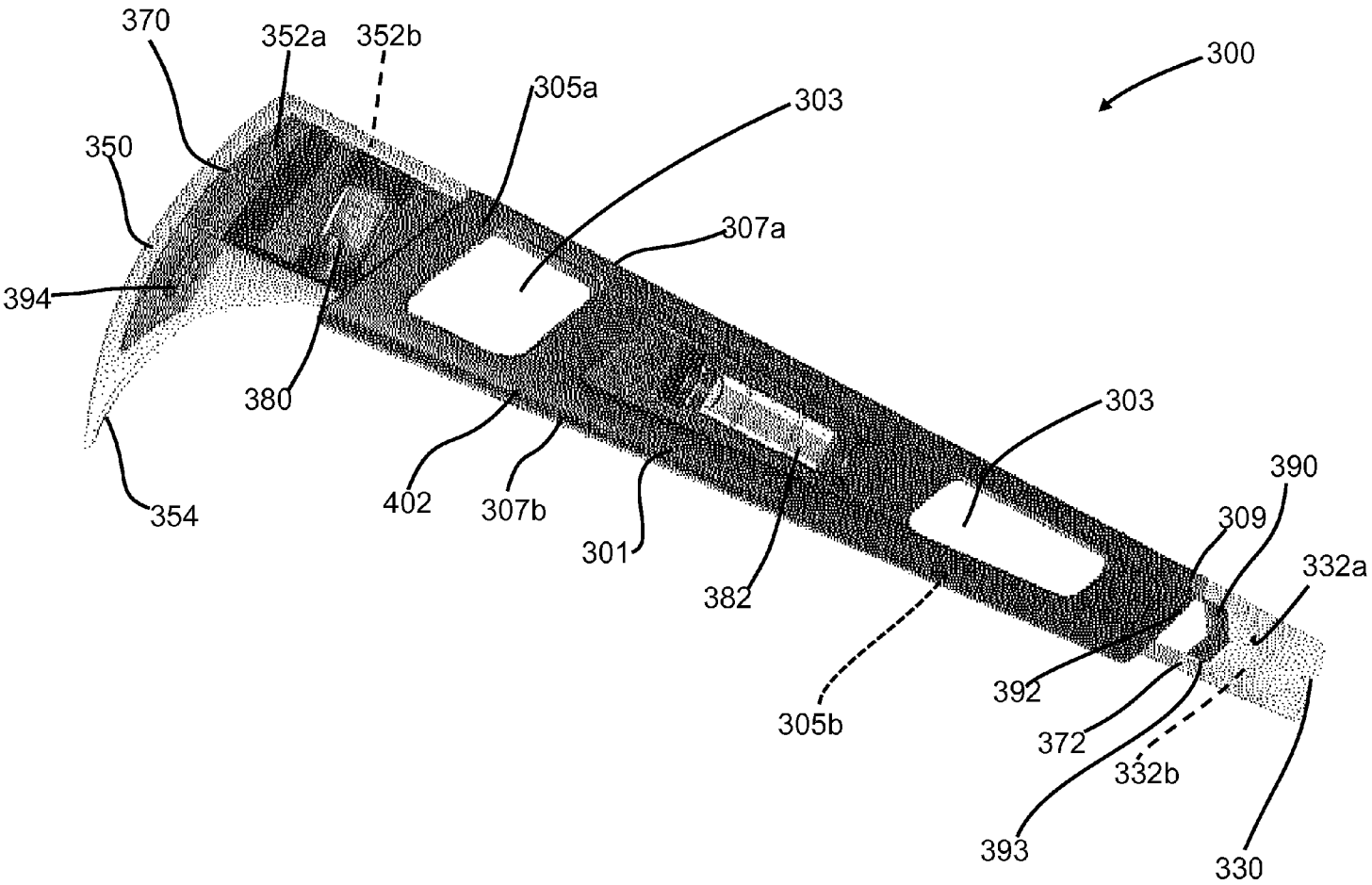
FIG. 4 is a top perspective view of the pulling tool of the present disclosure, according to another embodiment.

An alternate embodiment is depicted in FIG. 4. The embodiment 300 shown in FIG. 4 likewise comprises a tool 300 with an elongated handle 301. The elongated handle 301 is substantially encapsulated by a handle grip and padding material 384. In one embodiment, the handle grip and padding material 384 comprises a thermoplastic elastomer such as a polyvinyl chloride, or a mix of multiple thermoplastic elastomers, including ethylene-vinyl acetate.

The handle grip and padding material 384 is designed to extend the service life of the tool 300 by absorbing misstrikes, and vibrations, preventing damage to the tool 300 metallic core. The material 384 acts to mitigate and eliminate vibrations transferred from the handle 301 to a users' hand. In one embodiment, the handle grip and padding material 384 also acts as an electrical insulator. The handle grip and padding material 384 extends the length of the tool 300 with only the secondary tool zone 390 of the distal end 309 and first tool zone 370 of the pulling head 350 remaining exposed.

The handle grip and padding material 384 extends over the metallic core of the main body of the tool 300. The metallic core of the main body of the tool 300 is composed from steel, in one embodiment. In one specific embodiment, the tool 300 is made from carbon tool steel, with the grip and padding material 384 encapsulating the steel core. In one embodiment, the handle grip and padding material 384 is applied to the steel core through a process of injection molding.

The distal end 309 of the tool 300 defines a secondary tool zone 390 which includes the saw wrench 390 and a nail pick 330.

A nail pick 330 is extends from the end of the handle and grip material 384 to the end of the tool. The nail pick 330 defines a first surface 332*a* and a second surface 332*b*. In one embodiment, the plane defined by the first surface 332*a* is substantially at an acute angle with the plane defined by the second surface 332*b*. This allows the tool 300 to rest against the first surface 332*a*, while the nail pick 300 is driven in to engage a workpiece such as a nail. Given the angle between the first surface 332*a* and the second surface 332*b*, the tool can pivot around the nail pick 330 and pull out the engaged work piece.

The saw wrench 390 is designed to accept any appropriately shaped work pieces, such as hexagonal bolts and nuts. The saw wrench 390 defines a bearing surface 393. In one embodiment, an outer edge 392 of the saw wrench 390 is open. In the open configuration, the saw wrench 390 can accept work pieces having different sizes, so long as the work pieces may engage the bearing edge 393 of the wrench 390. Furthermore, the saw wrench 390 may be used as a bottle opener.

The pulling head 350 defines the end of the tool 300 which is opposite of the distal end 309. The pulling head 350 defines a claw or pulling surface 354 designed to engage a nail. The outer surface of the claw 354 is substantially curved to facilitate pivoting action at the head 350.

The head 350 defines a front surface 352*a* and a back surface 352*b*. Channels in the front surface 352*a* and the back surface 352*b* are filled with the gripping material 384. The gripping material which extends out to the head 350 is designed to mitigate vibrations in the head. A channel 394 is defined in the gripping material 384 extending the length of the head 350.

Turning to the handle 301, in one embodiment, the handle 301 comprises four sidewalls: two wider sidewalls 305*a*, 305*b* and two narrower sidewalls 307*a*, 307*b*. The first narrow sidewall 307*a* is substantially flat and extends from the pulling head 350 to the distal end 309 of the tool. The second narrow sidewall 307*b* extends from underneath the pulling head 350 to the distal end 309 of the tool 300.

A series of tape measure indicators 396 are located on the first narrower sidewall 307*a*, given that the sidewall is substantially flat. Views of the tool shown in FIGS. 5A and 5B clarify the placement of the tape measure indicators 396 along the sidewall 307*a*.

Furthermore, in one embodiment, the first narrower sidewall 307*a* is not encapsulated by the gripping material 384. In another embodiment, the first narrower sidewall 307*a* is encapsulated by the gripping material, but the gripping material is offset to ensure that both the encapsulated and non-encapsulated segments of the first narrower sidewall 307*a* are substantially flush forming a straight edge for the tape measure indicators 396.

Given the substantially flat profile of the first narrower sidewall 307*a*, that sidewall allows the tool 300 to act as a square to ensure that a wall is plumb.

Figure 6:
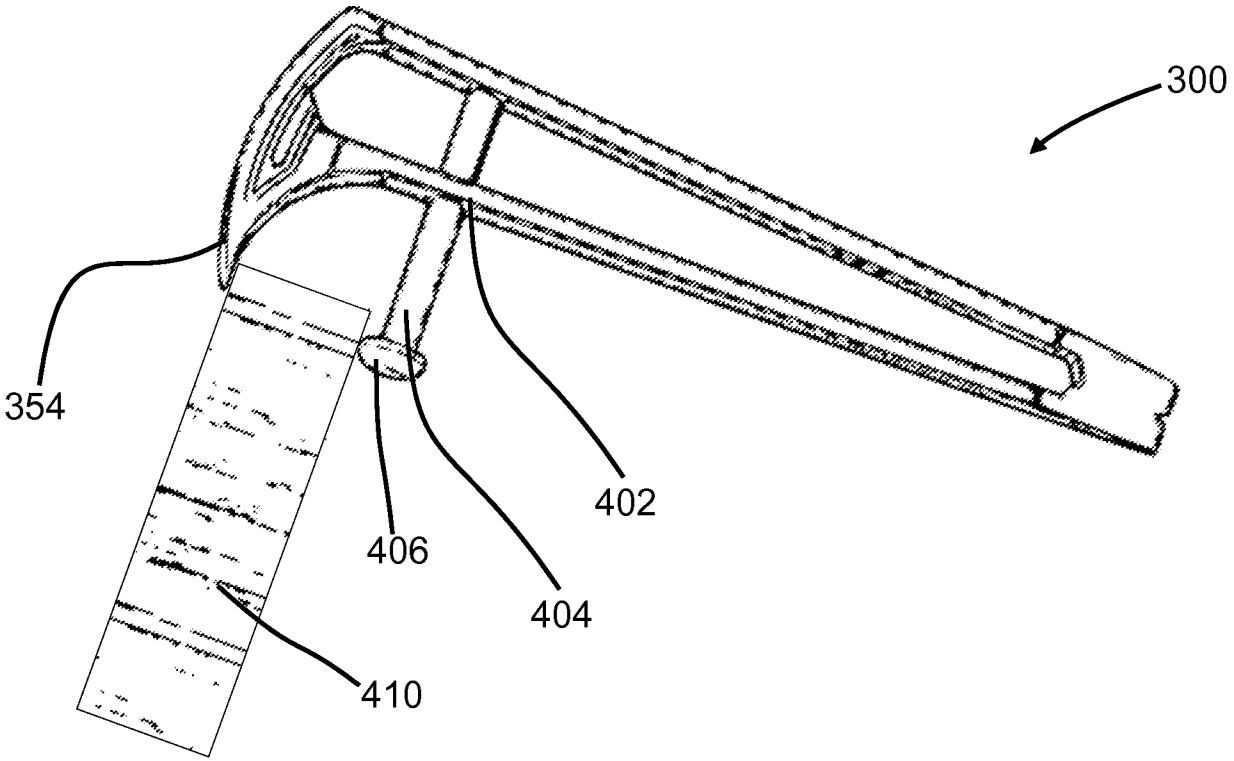
FIG. 6 is another side view of the pulling tool of FIG. 4.

An aperture 404 is defined in the secondary narrow handle edge 307*b*. The aperture 402 is designed to receive a bar. In one embodiment the bar is substantially round. The bar, once installed in the aperture 402, creates a secondary pivot point for the tool 300. In one instance, the second pivot point is used when the claw 354 is engaged in a nail. In one embodiment, the aperture 392 is threaded and receives the bar removably with the bar having compatible threads defined thereon. As depicted in FIG. 6, the aperture 402 receives a bolt 404, in one embodiment. A bolt 404 is defined as a bar having a head 406. In the embodiment shown in FIG. 6, the bolt 404 is removably inserted into the aperture 402. The head of the bolt 406 engages with the board 410, along with the claw 354 of the tool head 350. In one embodiment, bolts having different sized heads 406 are used with the tool 300, depending on the width of the board 410 which is to be bent by the tool 300. In another embodiment, a single bolt 404 is used, but the bolt 404 features an expandable head 406 which changes shape to accommodate various sizes of boards 410. For clarity, the remaining features of the device 300 in FIG. 6 are not shown (such as the levels 382, 380), but it should be understood that a tool having all of the accessories and features shown in FIG. 4 can be used in the manner shown in FIG. 6.

Two bubble levels 380 382 are defined in the main body of the tool, extending the plane defined by the tool handle wide sidewall 305*a*. In one embodiment, a first level 380 is substantially perpendicular to the first narrow edge 307*a* of the tool handle and is located in the tool zone 370 defined in proximity to the head 350 of the tool. A second level 382 is substantially parallel to the first narrow edge 307*a* of the tool handle. Inasmuch as the first narrow edge 307*a* is the straight edge of the tool, the levels 380 382 can be used to ensure that a surface against which the narrow edge 307*a* is resting against is both vertically and horizontally flat.

Figure 5A:
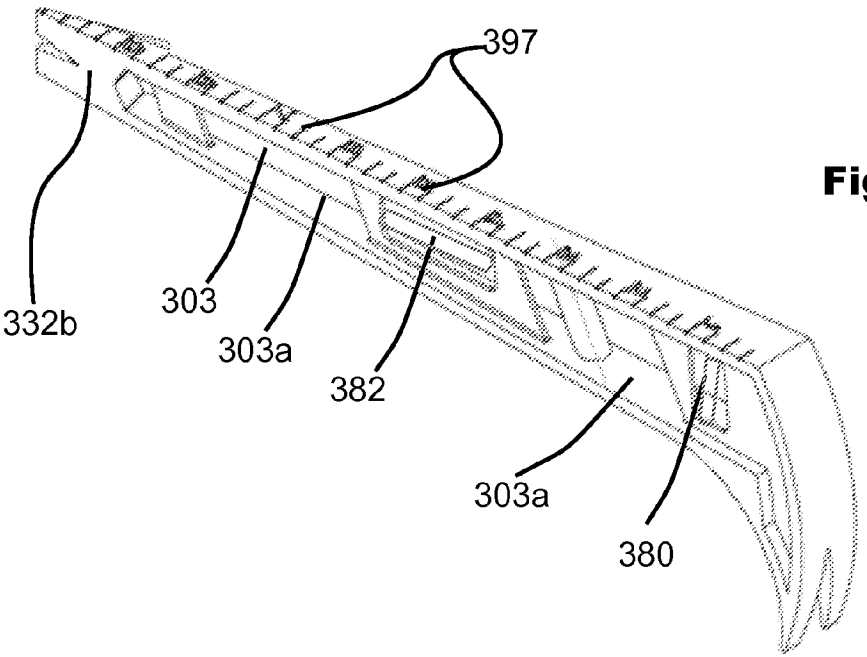
FIGS. 5A-5B are top and side views of the pulling tool of FIG. 4.
Figure 5B:
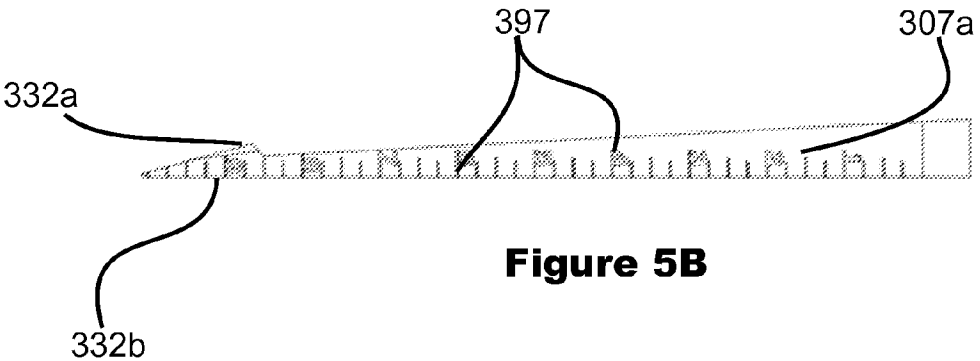

Two finger apertures 303 are defined in the handle 301 by extending from the first wide handle sidewall 305*a* to the second wide handle sidewall 305*b*. The finger apertures allow for two points of contact while the user is interacting with the tool 300. In one embodiment, the finger apertures 303 are encompassed by gripping material 384. As shown in FIG. 5A, in one embodiment, the interior surfaces 303A of the finger apertures 303, remain exposed and free of the padding material 384.

A benefit of the second embodiment of the tool 300 is that it is lighter than the first embodiment 100 while providing equivalent features. The second embodiment 300 weighs only about one pound. The second embodiment is furthermore easier to manufacture and includes plastic molded surfaces, which benefit the end user.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is:

1. A tool comprising:

a handle portion adapted to be gripped by a user wherein the handle portion further comprises four interconnected surfaces comprising two sidewall surfaces and two edge surfaces wherein each sidewall surface is broader than each edge surface; and a plurality of tool zones defined within the tool, each tool zone having a plurality of structures wherein a first tool zone comprises structures operable with said handle surface portion and adapted to perform at least one function, wherein said plurality of structures comprises at least one of a saw wrench, and a set of tape measure indicators; and a pulling head wherein said pulling head extends from an end of the handle portion.

2. The tool of claim 1, wherein said saw tool zone is located on a front surface of a tool head wherein said front surface is coplanar with one sidewall surface of the handle.

3. The tool of claim 2, wherein said saw wrench tool is a hexagonal-shaped recess disposed proximate the handle portion.

4. The tool of claim 3, wherein said saw wrench tool further comprises a bearing edge and an open outer edge opposite of the bearing edge.

5. The tool of claim 1, further comprising two level indicators.

6. The tool of claim 5, wherein one level indicator is substantially parallel to the second level indicator.

7. The tool of claim 1 wherein the tool zone terminates in a non-threaded puller.

8. The tool of claim 1, wherein said tape measure indicators extend over a narrow edge of the handle wherein said narrow edge is substantially flat.

9. The tool of claim 1, wherein said handle has at least one grip-enhancing feature wherein the grip-enhancing feature is defined in a sidewall surface.

* * * * *